US005193927A

United States Patent [19]

Kageyama et al.

[11] Patent Number: 5,193,927

[45] Date of Patent: Mar. 16, 1993

[54] MECHANICAL PENCIL HAVING PROPELLING DEVICE FOR A BAR SHAPED ARTICLE

[75] Inventors: Shuehi Kageyama; Yoshihide Mitsuya; Kazuo Gomi, all of Kawagoeshi, Japan

[73] Assignee: Kotobuki & Co., Ltd., Kyoto, Japan

[21] Appl. No.: 494,095

[22] Filed: Mar. 15, 1990

[30] Foreign Application Priority Data

Mar. 24, 1989 [JP] Japan ..... 1-34009
Jun. 30, 1989 [JP] Japan ..... 1-77565
Sep. 18, 1989 [JP] Japan ..... 1-109296

[51] Int. Cl.[5] ..... B43K 29/02

[52] U.S. Cl. ..... 401/52; 401/19; 401/31; 401/78

[58] Field of Search ..... 401/52, 29-32, 401/19, 76, 77, 75, 86, 17; 15/429, 430, 431, 433

[56] References Cited

U.S. PATENT DOCUMENTS 1,447,727 3/1923 Kendall ..... 401/31 X
2,529,673 11/1950 Blake ..... 401/78
3,310,168 3/1967 Landen ..... 401/78 X
4,136,980 1/1979 Leem ..... 401/31
4,380,402 4/1983 Andrews et al. ..... 401/78 X
4,560,297 12/1985 Leem ..... 401/31
5,015,111 5/1991 Petterson ..... 401/52
5,022,774 6/1991 Kageyama ..... 401/78 X

FOREIGN PATENT DOCUMENTS 393377 10/1990 European Pat. Off. ..... 401/31
2629319 4/1978 Fed. Rep. of Germany ..... 401/78
2143212 2/1985 United Kingdom ..... 401/78
8810198 12/1988 World Int. Prop. O. ..... 401/52

*Primary Examiner*—Danton D. DeMille
*Attorney, Agent, or Firm*—David O'Reilly

[57] ABSTRACT

Working out container of bar shaped article such as mechanical pencil in which a holder slides along a slit of a inner sleeve by rotating a outer sleeve relative to a inner sleeve and the bar shaped article 9 held in the holder, such as a crayon, a pastel, thick pencil lead, lip stick, eye brow can be used instead of the bar shaped erasing gum, projects from or retracts from a head, characterized in that the holder is inserted from the annular stopper for ease of assembling, or characterized in that more than one recesses 29, 29 are provided on the holder 25, or a radial recess 52 is provided on the slit 43 of the inner sleeve 44, the holder 45 is mounted in the recess 52, the mounting of the holder into the inner sleeve 24 can be performed easily and fast.

3 Claims, 12 Drawing Sheets

MECHANICAL PENCIL HAVING PROPELLING DEVICE FOR A BAR SHAPED ARTICLE

FIELD OF THE INVENTION

This invention relates to working out container for a bar shaped article such as mechanical pencil having a holder that slides along a slit of a inner sleeve by rotating the outer sleeve relative to the inner sleeve with the bar shaped article held in the holder, such as a crayon, a pastel, a thick pencil lead, a lip stick, an eye brow stick can be used instead of a bar shaped erasing gum, that projects from or retracts from a head end.

BACH GROUND OF INVENTION

Heretofore, many kinds of working out containers for a bar shaped article propose having a helical groove 3 provided on the inner face of a sleeve cap 1, a slit 6 provided on a sleeve member 5, and a holder 7 for a bar shaped article 9 slidably mounted on the slit 6.

For example, the slit 6 extends to the rear end of the sleeve member 5 and divides the sleeve member 5. The bar shaped article holder 7 has inward and outward resilience and thus produces play in use, and escapement of the holder 7 might occur from the rear end of the slit 6.

To prevent this defect, another member is provided at the rear eend of the slit 6, or the slit is interrupted at a halfway point and the bar shaped article holder 7 is inserted from the slit 6. But this increases the cost, produces play in the holder 7, lowers the strength at the non slit part and might be broken in use.

Inventors have proposed devices in Japanese utility model application Nos 62-155301 and 62-155302.

These prior applications disclose a bar shaped article receiver having a helical groove 22 provided on the inner face of an outer sleeve 21, a holder 25 mounted in an inner sleeve 24 having a slit 23. A projection 26 on the holder 25 engages the helical groove 22 through the slit 23. A bar shaped article 27 held by the holder 25 is projected or retracted from a head 28 by rotation of the outer sleeve 21 relative to the inner sleeve 24.

However, in said prior art, the holder is inserted from the side of a slit in the inner sleeve or one of the holding pieces is inserted from the side of the head of an inner sleeve (annular stopper) so as to rotate the holder, then these holding pieces are slidably mounted and guided in the slit. Therefore, mounting the holder in the sleeve is not easy, especially in former prior art devices. When the slit is narrow, mounting becomes very difficult, and in the latter prior art, in the case of a longer head, (the bar shaped article in the application filed on Jun. 19th 1989) the mounting of the holder becomes nearly impossible.

BRIEF DESCRIPTION OF THE INVENTION

This invention intends to eliminate said drawbacks, and an object of this invention is to provide a working out container for a bar shaped article having a bar shaped article holder that slides along a slit by rotating a sleeve cap. The bar shaped article projects from or retracts into a sleeve according to the direction of rotation, characterized by the holder being inserted from the annular stopper for ease of assembly.

Another object of this invention is to provide a working out container for a bar shaped article having a helical groove 3 provided on the inner face of a sleeve cap 1, an annular stopper 14 and a slit 6 provided on a sleeve member 5. A holder 7 for a bar shaped article 9 is slidably mounted in the slit 6, characterized working it possible to insert the holder 7 from the annular stopper 14.

For slidably mounting the bar shaped article holder 7 in the slit 6, the holder 7 is inserted into the slit 6 from the stopper side 14. The bar shaped article holder 7 is slidably guided into the slit 6 of the sleeve member 5.

Another object of this invention is to provide a working out container for a bar shaped article having a helical groove 22 provided on the inner face of an outer sleeve 21, a holder 25 mounted in an inner sleeve 24 having a slit 23, and a projection 26 of the holder 25 engageing the helical groove 22 through the slit 23. A bar shaped article 27 held by the holder 25 is projected or retracted from a head 28 by rotation of the outer sleeve 21 relative to the inner sleeve 24, characterized by a plurality of recesses 29, 29 provided on the holder 25.

In the second claim of this invention, a helical groove 22 is provided on the inner face of an outer sleeve 21. A holder 25 is mounted in an inner sleeve 24 having a slit 23, and a projection 26 of the holder 25 engages into the helical groove 22 through the slit 23. A bar shaped article 27 held by the holder 25 is projected or retracted from a head 28 by rotating the outer sleeve 21 relative to the inner sleeve 24, characterized by holding pieces 30, 30 provided on the holder 25. These holding pieces are slidably mounted in the slits 23, and a bar shaped article 27 is held in these holding pieces 30, 30. A projection 26 engages the helical sleeve 22 provided on the holding piece 30, a plurality of recesses 29, 29 are provided on the holder 25.

In the first claim, the holder 25 is pressed into the head 28 of the inner sleeve 24 from the side where recesses 29 are not provided. The holder 25 deforms inwardly at the recesses 29 and can pass through the head 28 into inner sleeve 24. The projections 26 on the holder 25 are mounted in the slit 23 and the holder 25 can be slidably inserted into the inner sleeve 24.

Still another object of the invention is to provide a working out container for a bar shaped article having the holder 25 pressed into the head 28 of the inner sleeve 24 from the side where recesses 29 are not provided, with the holding piece 30 of the holder 25 deforming inwardly at the recesses 29 so it can pass through the head 28 into inner sleeve 24. The holding piece 30 of the holder 25 is mounted in the slit 23 and the holder 25 can be slidably inserted into the inner sleeve 24.

Still another object of this invention is to provide a working out container for a bar shaped article having a helical groove 42 provided on the inner face of an outer sleeve 41, a holder 45 mounted in an inner sleeve 44 having a slit 43, and a projection 46 of the holder 45 is engaging the helical groove 42 through the slit 43. A bar shaped article 47 held by the holder 45 is projected or retracted from a head 48 by rotation of the outer sleeve 41 relative to the inner sleeve 44, characterized by a radial recess 52 provided on the slit 43 of the inner sleeve 44, with the holder 45 mounted in the radial recess 52. The holder 45 enters into the radial recess 52 provided on the slit 43 of the inner sleeve 44, to be assembled into the inner sleeve 44.

The above and other objects, advantages and novel features of this invention will be more fully understood from following detailed description and the accompanying drawings, in which like reference numbers indicate like or similar parts throughout wherein;

DETAILED DESCRIPTION OF THE INVENTION

Figure 1:
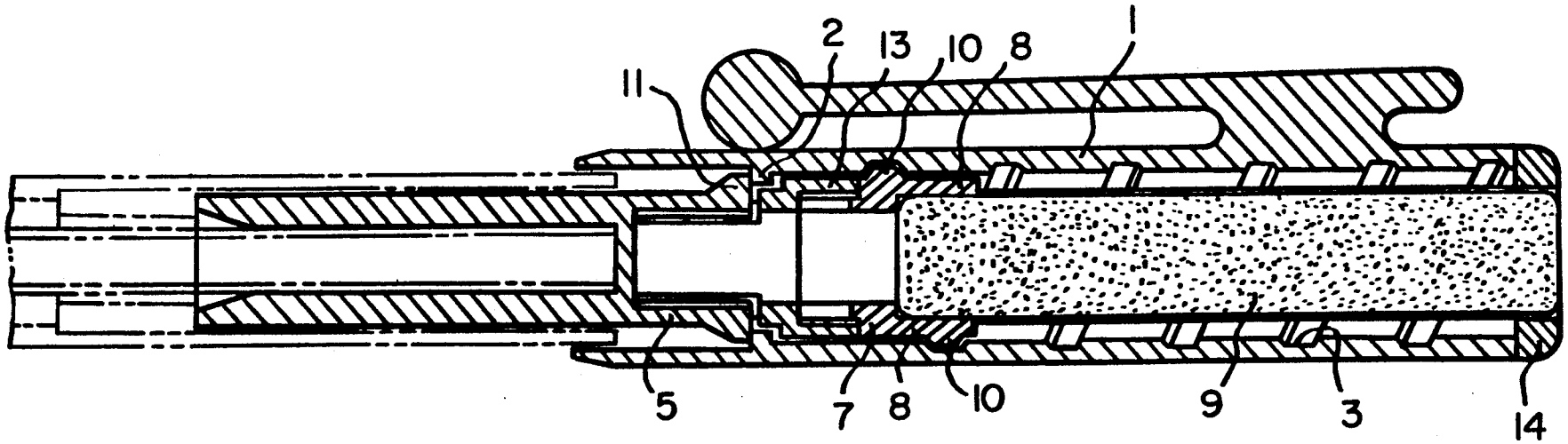
FIG. 1 is a longitudinal cross section of one embodiment of this invention.
Figure 2:
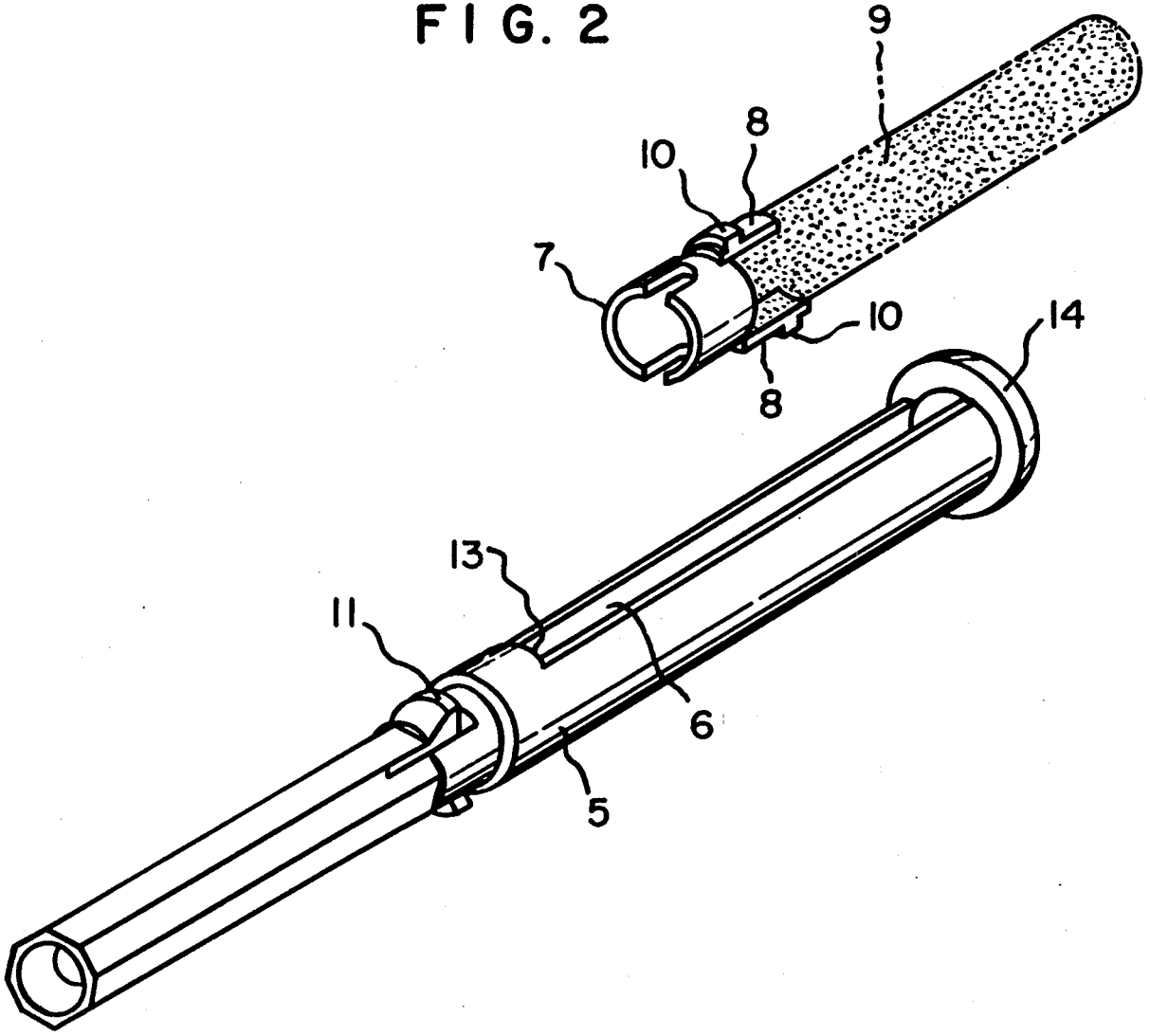
FIG. 2 is an exploded perspective view an essential part of the embodiment of FIG. 1.
Figure 3A:
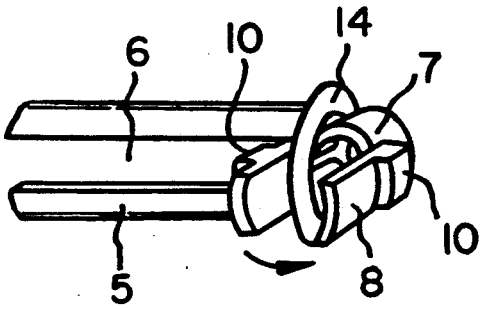
FIG. 3*a* to *c* show steps for mounting the holder 7 in the slit of a sleeve.
Figure 3B:
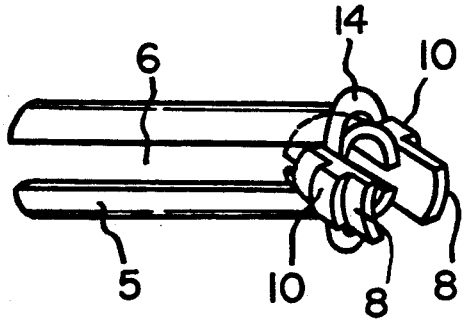
Figure 3C:
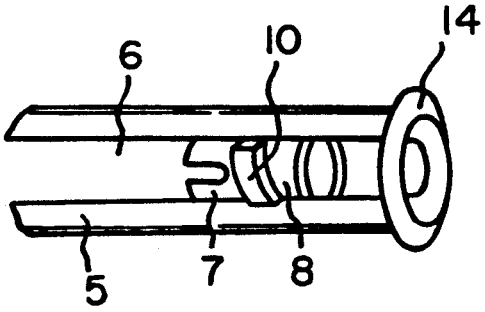
Figure 4:
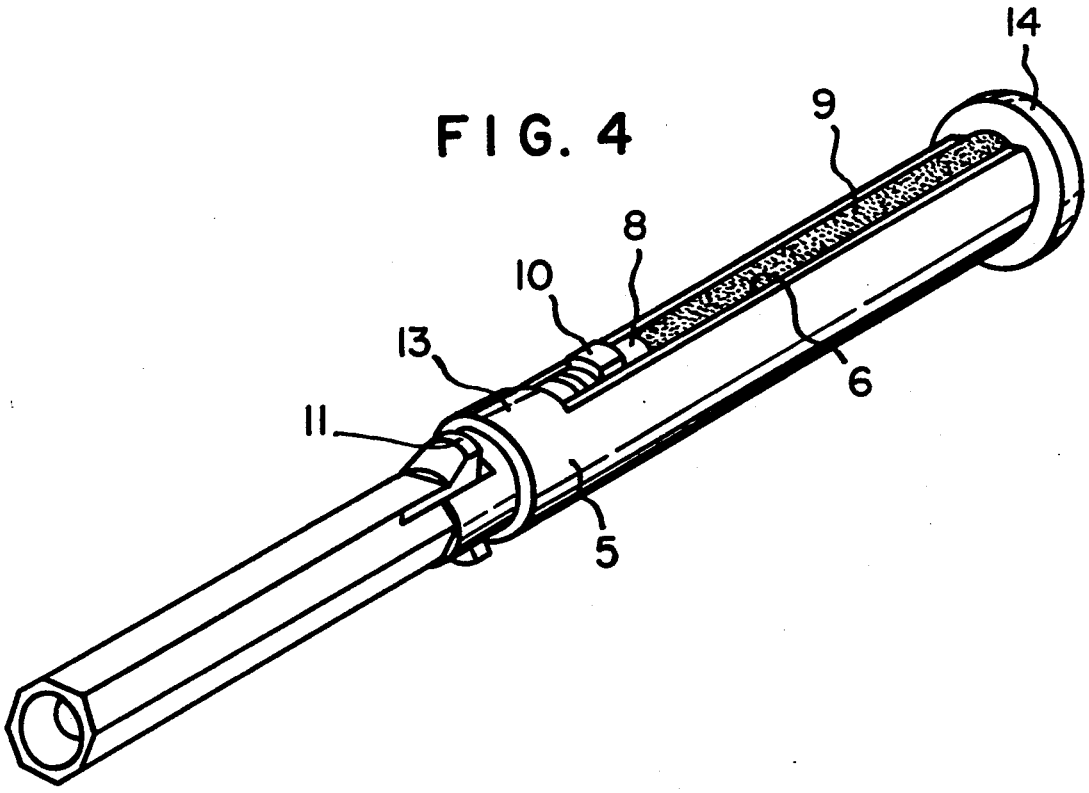
FIG. 4 is a perspective view of the guiding position of a holder

FIG. 1 is a longitudinal cross-section of one embodiment of this invention. FIG. 2 is an exploded perspective view of an essential part of the embodiment FIG. 1. FIGS. 3*a* to *c* show the steps for mounting holder 7 into slit 6 of sleeve 5. FIG. 4 is a perspective view of the guiding position of holder 7.

In the figures a sleeve cap 1 having step 2 at a front inner face, and helical groove 3 at rear inner face, with sleeve member 5 to be inserted into sleeve cap 1 from rear end. Sleeve member 5 has projection 11 at a middle outer face to be engaged by step 2 and a pair of slits 6, 6 at the opposite sides opposing the rear part of sleeve member 5. In this embodiment, projection 11 is formed by cutting into the outer face of sleeve member 5 to provide a step for step 2 of sleeve cap 1.

A pair of holding pieces 8, 8 of bar shaped article holder 7 are directed rearward and guided in a pair of slits 6, 6. An Erasing gum 9 is held between holding piece 8, 8. Annular stoppers 13, 14 are formed at the front and rear ends of slit 6 receiving bar shaped article holder 7. Therefore, bar shaped article holder 7 can slide in an axial direction between stoppers 13, 14 until abutting the ends of stoppers 13, 14. Projections 10, 10 provided on holding pieces 8, 8 engage helical groove 3.

The following will explain the method of assembling this embodiment.

At first, as shown in FIG. 3, one holding piece 8 of bar shaped article holder 7 is inserted through annular stopper 14 and rotated as shown by the arrow, The holding pieces 8, 8 of bar shaped article holder 7 are thus slidably mounted in and guided by slits 6, 6 of sleeve member 5.

Then, erasing gum 9 is inserted from the rear end of sleeve member 5 and held between holding pieces 8, 8 as shown in FIG. 4. Sleeve member 5 is then pushed into the rear end of sleeve cap 1, with projections 11, 11 being bent inwardly to pass through and engage step 2. Annular stopper 14 contacts the rear end of sleeve member 5 to finish the assembly. Adding erasing gum 9 to holding pieces 8, 8 may be performed after assembling of sleeve member 5 in sleeve cap 1.

In this embodiment, bar shaped article holder 7 can be assembled easily from the rear end of annular stopper 14, and holding pieces 8, 8 of bar shaped article holder 7 are guided by slits 6, 6, and bar shaped erasing gum 9 is held between the holding pieces 8, 8. Bar shaped erasing gum 9 is supported by the non-slitted part of sleeve holder 5 without bending and without the necessity of slimming the base by secondary work because the diameter of the erasing gum 9 may be constant throughout the whole length which is approximately equal to inner diameter of sleeve member 5.

Erasing gum 9 is advanced or retracted by rotation of sleeve cap 1 according to the rotating direction as usual.

In this embodiment, a crayon, a pastel, a thick pencil lead, lip stick, or an eye brow stick can be used instead of bar shaped erasing gum 9.

As explained above, according to this invention, helical groove 3 is provided on the inner face of sleeve cap 1, annular stopper 14 and slit 6 are provided on sleeve member 5, holder 7 for a bar shaped article 9 is slidably mounted on the slit 6, characterized by holder 7 being possible to insert through annular stopper 14, the bar shaped article holder 7 is easily assembled through annular stopper 14, and as holding pieces 8, 8 of the bar shaped article holder 7 are guided in the pair of slits 6, 6 and bar shaped erasing gum 9 is held between holding pieces 8, 8, bar shaped erasing gum 9 is supported by the non-slit part of sleeve holder 5 without bending and the necessity of slimming the base by secondary work because the diameter of erasing gum 9 may be constant through the whole length which is approximately equal to the inner diameter of sleeve member 5.

Figure 5:
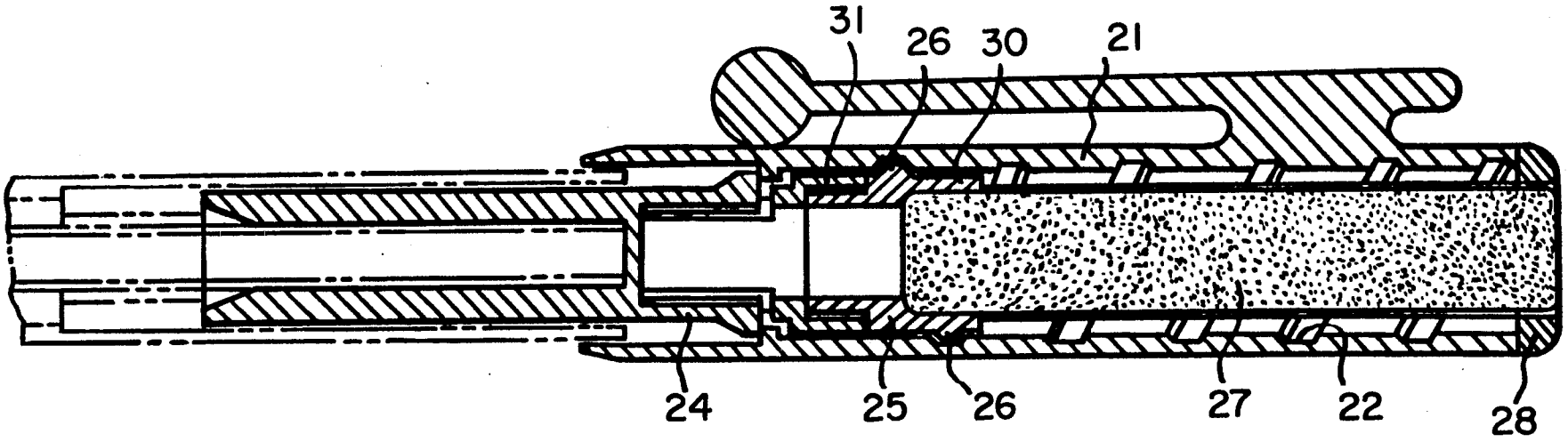
FIG. 5 is a longitudinal cross section of a second embodiment of the invention.
Figure 6:
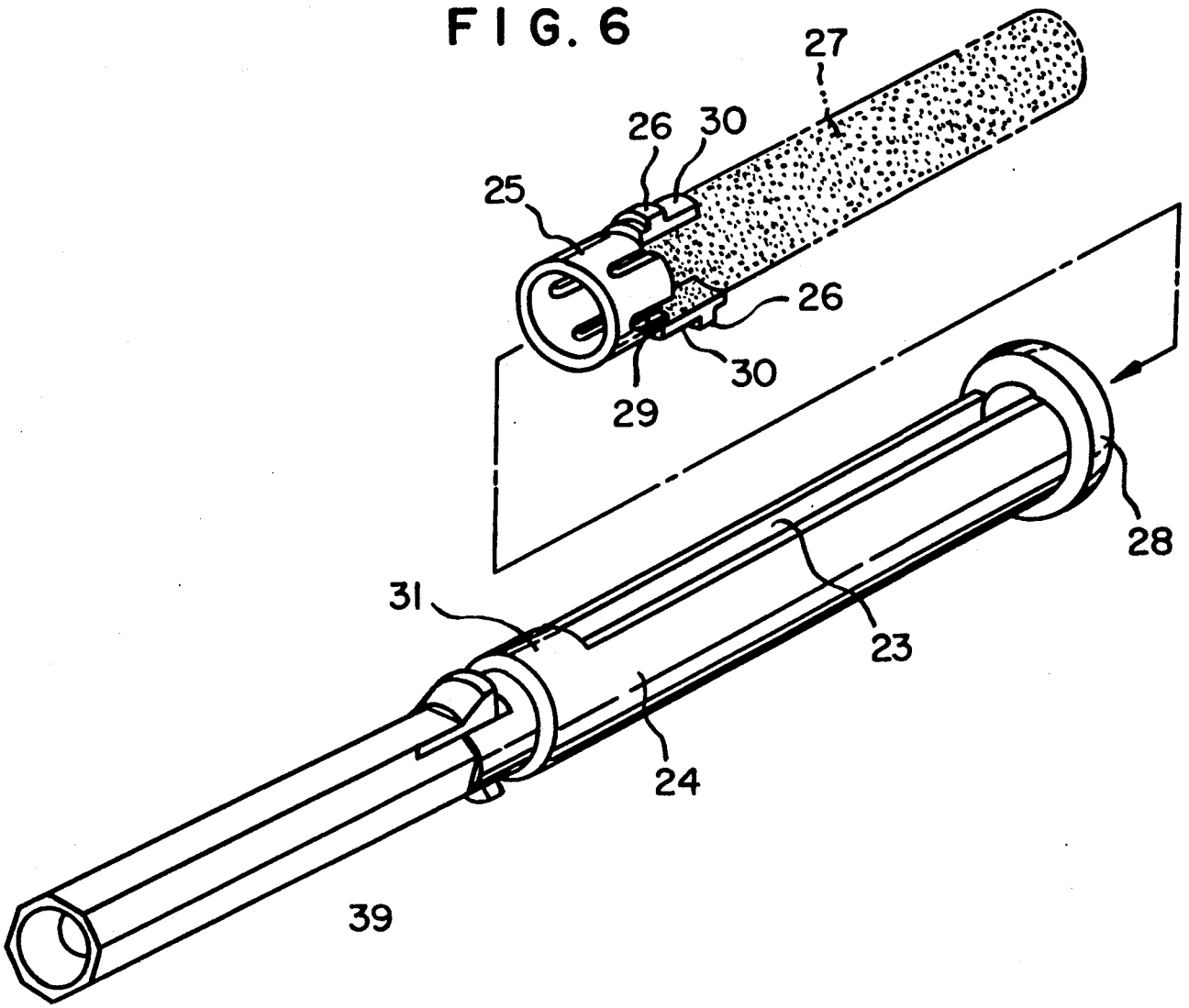
FIG. 6 is an exploded perspective view of an essential part of the embodiment of FIG. 5.
Figure 7:
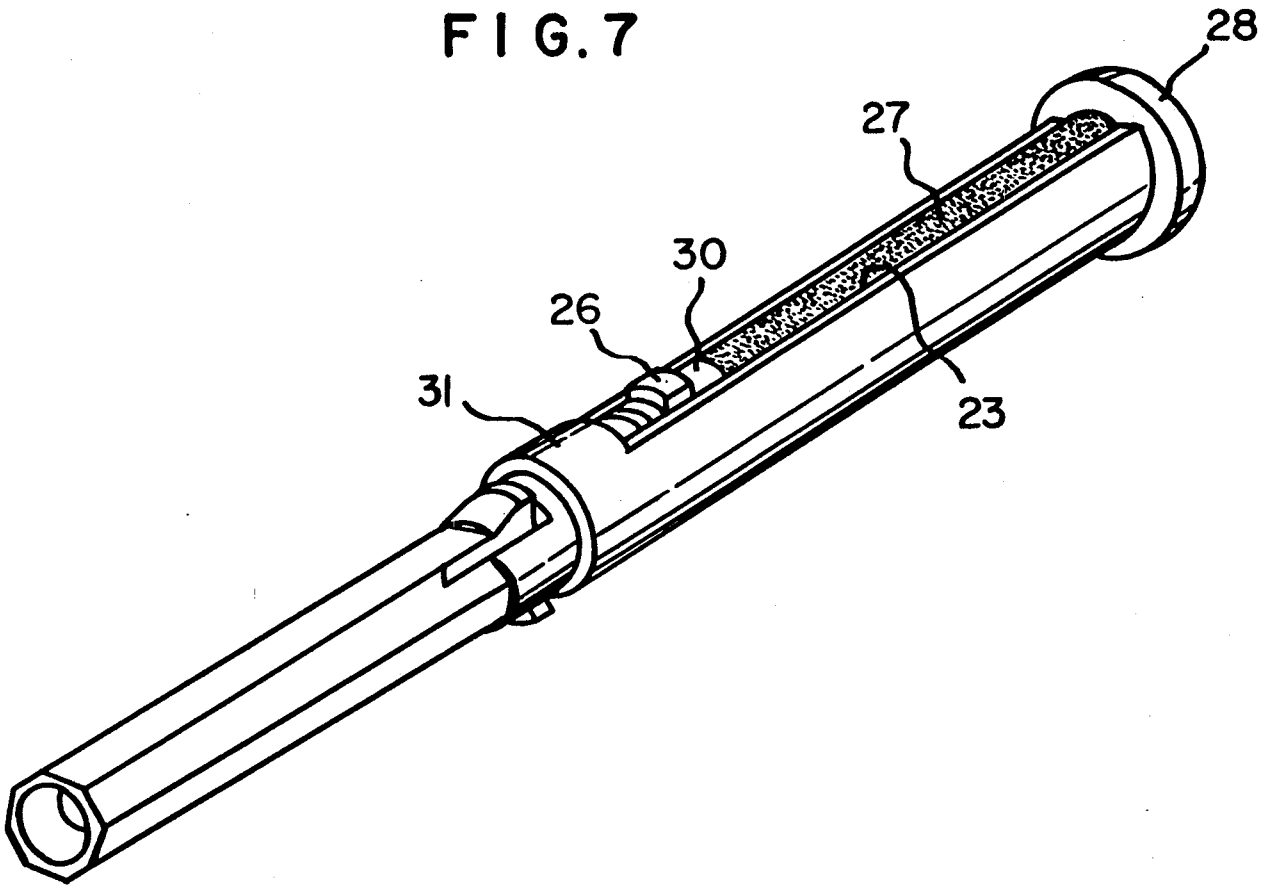
FIG. 7 is a perspective view of a holder mounted in the slit of an inner sleeve having a bar shaped article according to the second embodiment.

FIG. 5 is a longitudinal cross section of a second embodiment of the invention. FIG. 6 is an exploded perspective view of an essential part of thus embodiment. FIG. 7 is a perspective view of holder 25 mounted in slit 23 of inner sleeve 24 having the bar shaped article 27 of the second embodiment.

In FIGS. 5~7, outer sleeve 21 has helical groove 22 provided on the inner face of outer sleeve 21. Inner sleeve 24 is inserted in the outer sleeve from the rear side, and a pair of slits 23 are provided at the rear part of the inner sleeve 24. Two holding pieces 30, 30 of holder 25 are slidably mounted in slits 23, 23 and directed rearward and bar shaped article 27 is held between holding pieces 30, 30.

Projections 26, 26 provided on the holding pieces 30, 30 engage the helical groove of outer sleeve 21. In the first embodiment, a plurality of recesses 29, 29, 29, 29 are provided in holder 25 on opposite sides of holding pieces 30, 30.

The following will explain the method of assembling in this embodiment. Holder 25 is pressed into head 28 of inner sleeve 24 from the side where recesses 29 are not provided. Holder 25 flexibly deforms inwardly at recesses 29 to pass through head 28 of inner sleeve 24. Holding piece 30 of holder 25 is mounted in slit 23 with holder 25 slidably inserted in inner sleeve 24. After, bar shaped article 27 is inserted in head 28 and held by holding pieces 30, 30. When outer sleeve 21 is rotated relative to inner sleeve 24, the holder 25 is guided and shifted in an axial direction along slits 23, 23 through the engagement between projection 26 and helical groove 22, thus bar shaped article 27 is projected or retracted from head 28.

Figure 8:
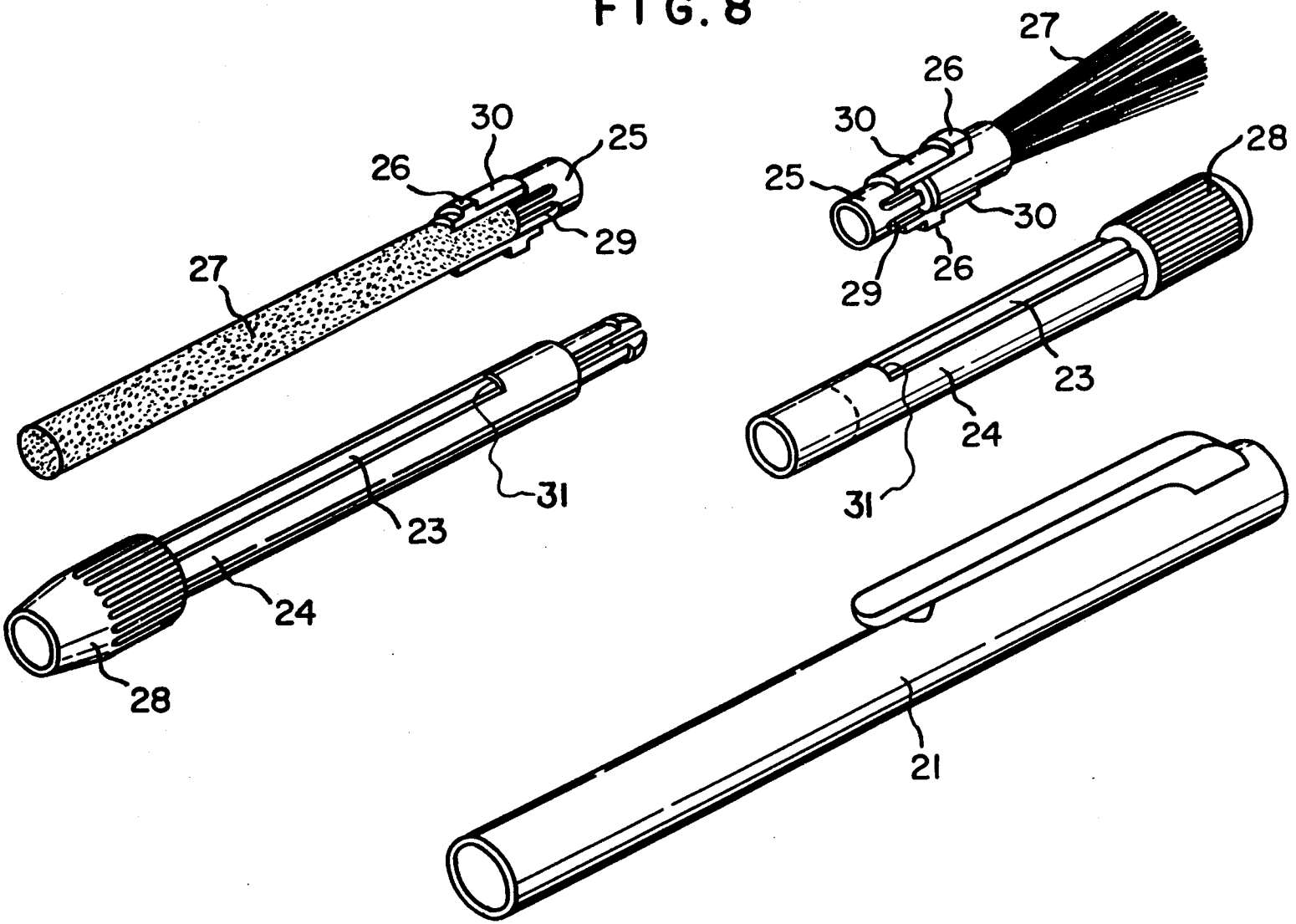
FIG. 8 is an exploded perspective view of an essential part of another embodiment.
Figure 9:
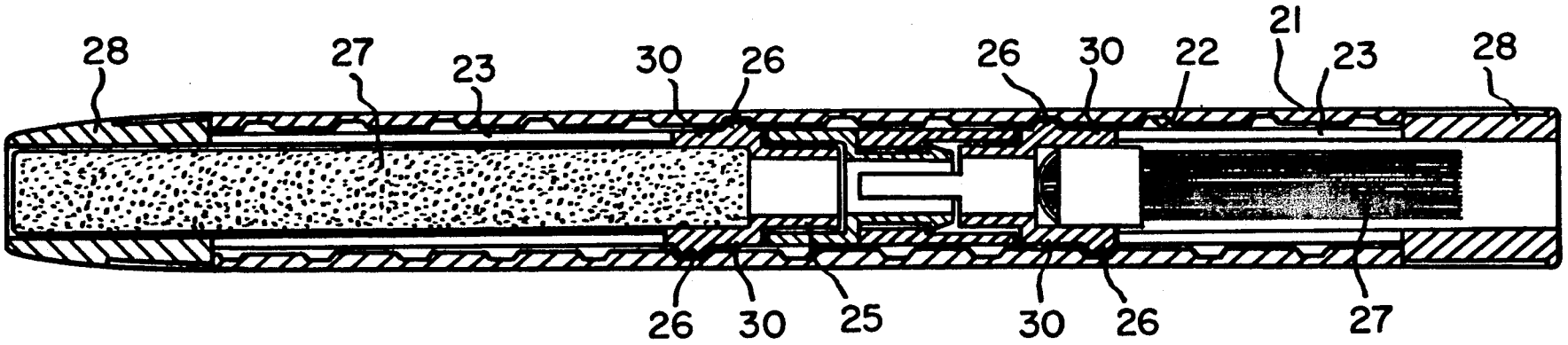
FIG. 9 is a cross-sectional view of the embodiment of FIG. 8.

FIG. 8 is an exploded perspective view of an essential part of the third embodiment. FIG. 9 is a cross-section view of this embodiment.

In FIGS. 8, 9, outer sleeve 21, has a helical groove 22 provided on the inner face of outer sleeve 21. Inner sleeves 24, 24 are inserted into the outer sleeve 21 from the rear and front ends respectively, and a pair of slits 23 are provided at the middle part of inner sleeve 24. Holders 25, 25 are inserted into the inner sleeve 24 through head 28, 28. Two holding pieces 30, 30 of holders 25, 25 are slidably mounted in both respective slits 23, 23 so as to be directed rearward and after insertion of the holders 25, 25 bar shaped article 27 is inserted through head 28 and held between the holding pieces 30, 30.

Stopper 31 and head 28 act as a stopprovided at opposite ends of slits 23 in holders 25. Consequently, the holders can move reciprocally in an axial direction within the range between the stops 31 and end of holder 28.

Projections 26, 26 provided on holding pieces 30, 30 engage helical groove 22 of the outer sleeve 21. In this third embodiment, recesses 29, 29, 29, 29 are provided in holders 25, 25 respectively on opposite sides of holding pieces 30, 30.

The following will explain the method of assembling this third embodiment. The holder 25 is pressed into head 28 of inner sleeve 24 from the side where recesses 29 are not provided. Holding pieces 30, 30 are flexibly deformed inwardly at recesses 29 and can pass through head 28 of inner sleeve 24. Holding piece 30 of the holder 25 is mounted in slit 23 and holder 25 is slidably inserted into the inner sleeve 24.

When the outer sleeve 1 is rotated relative to the inner sleeve 24, holder 25 is guided and shifted in an axial direction along slits 23, 23 through engagement between projection 26 and helical groove 22, thus bar shaped article 27 is projected or retracted from head 28 according to the direction of rotation.

In the second and third embodiments, holding piece 30 is provided on holder 25. Holding piece 30 is slidably mounted in slit 23, and bar shaped article 27 is held in the holding piece 30. Projection 26 engages helical groove 22 provided in the outer sleeve, but the holding piece 30 may be omitted if desired.

Figure 10:
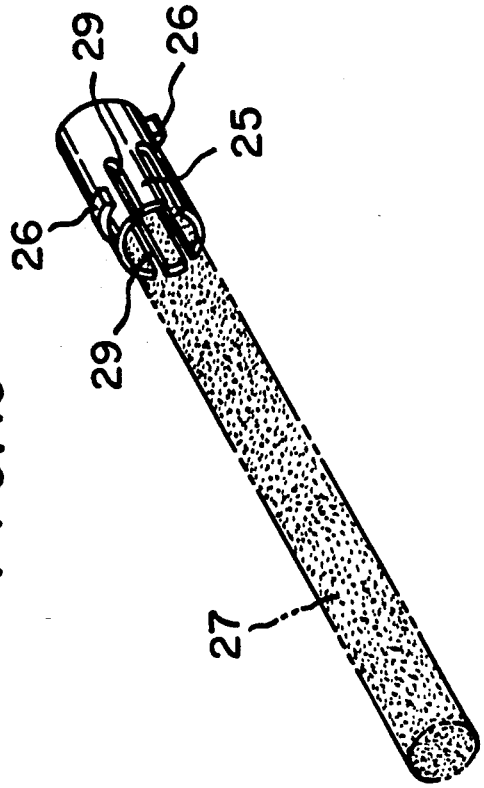
FIG. 10 is a perspective view of a holder of the fourth embodiment of this invention without the holding piece.

FIG. 10 is a perspective view of a holder of the fourth embodiment of this invention in which holding piece 30 is omitted. In the fourth embodiment, holder 25 has projections 24 which engage helical groove 22 through slit 23, and recesses 29, 29, 29, 29 are provided on the holder 25 on opposite sides adjacent projections 26, 26.

In use this holder 25, is pressed into the head 28 of the inner sleeve 24 from the side where recesses 29 are not provided. Holder 25 is bent or flexibly deformed inwardly at recesses 29 and can pass through head 28 of inner sleeve 24. Projection 26 of the holder 25 is mounted the slit 23 and is slidably inserted into inner sleeve 24. After mounting of holder 25, the bar shaped article 27 is inserted through head 28 and held by holder 25.

As explained above, according to this invention, holder 25 is pressed into the head 28 of inner sleeve 24 from the side where recesses 29 are not provided, and deforms inwardly at recesses 29 and can pass through the head 28 into inner sleeve 24, Projection 26 of holder 25 is mounted in slit 23 and holder 25 is slidably inserted in inner sleeve 24, so that in the case of a narrow slit 23, or a longer head 28 in the axial direction, mounting of the holder in inner sleeve 24 can be performed easily and fast.

Figure 11:
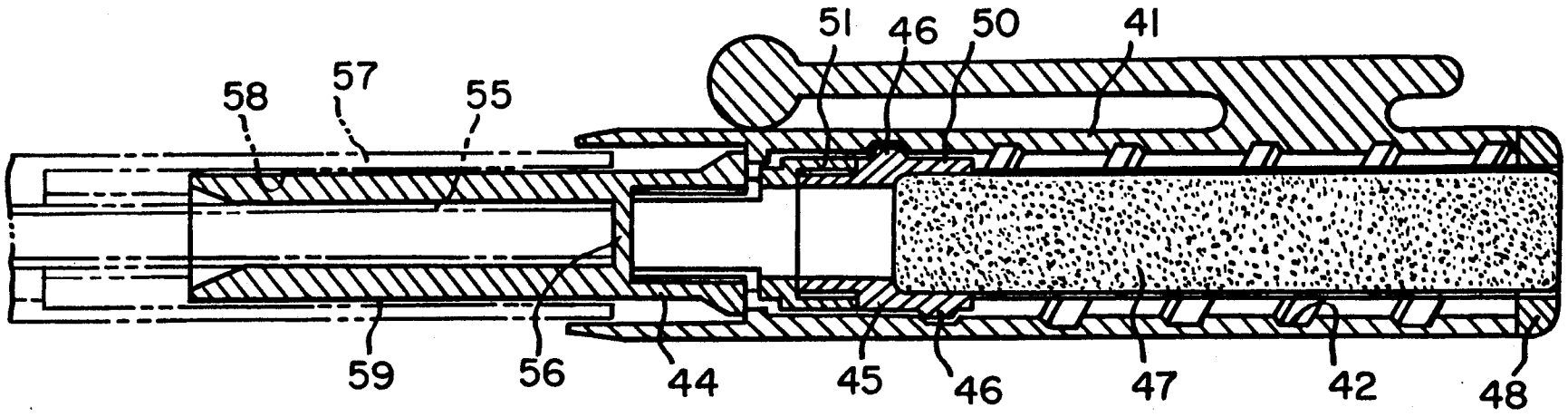
FIG. 11 is a longitudinal cross-section of a fifth embodiment of the invention.
Figure 12:
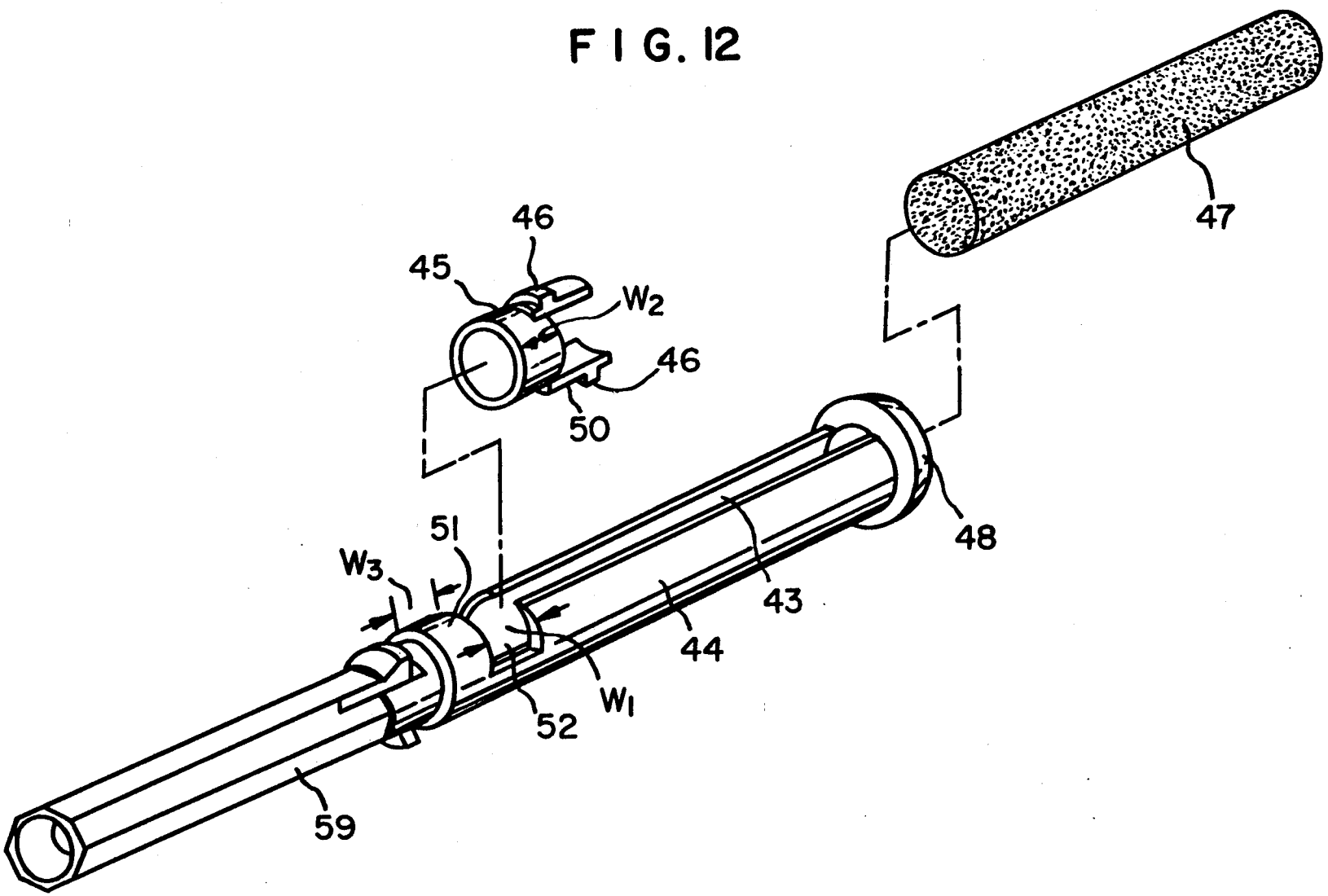
FIG. 12 is an exploded perspective view of an essential part of the embodiment of FIG. 11.
Figure 13:
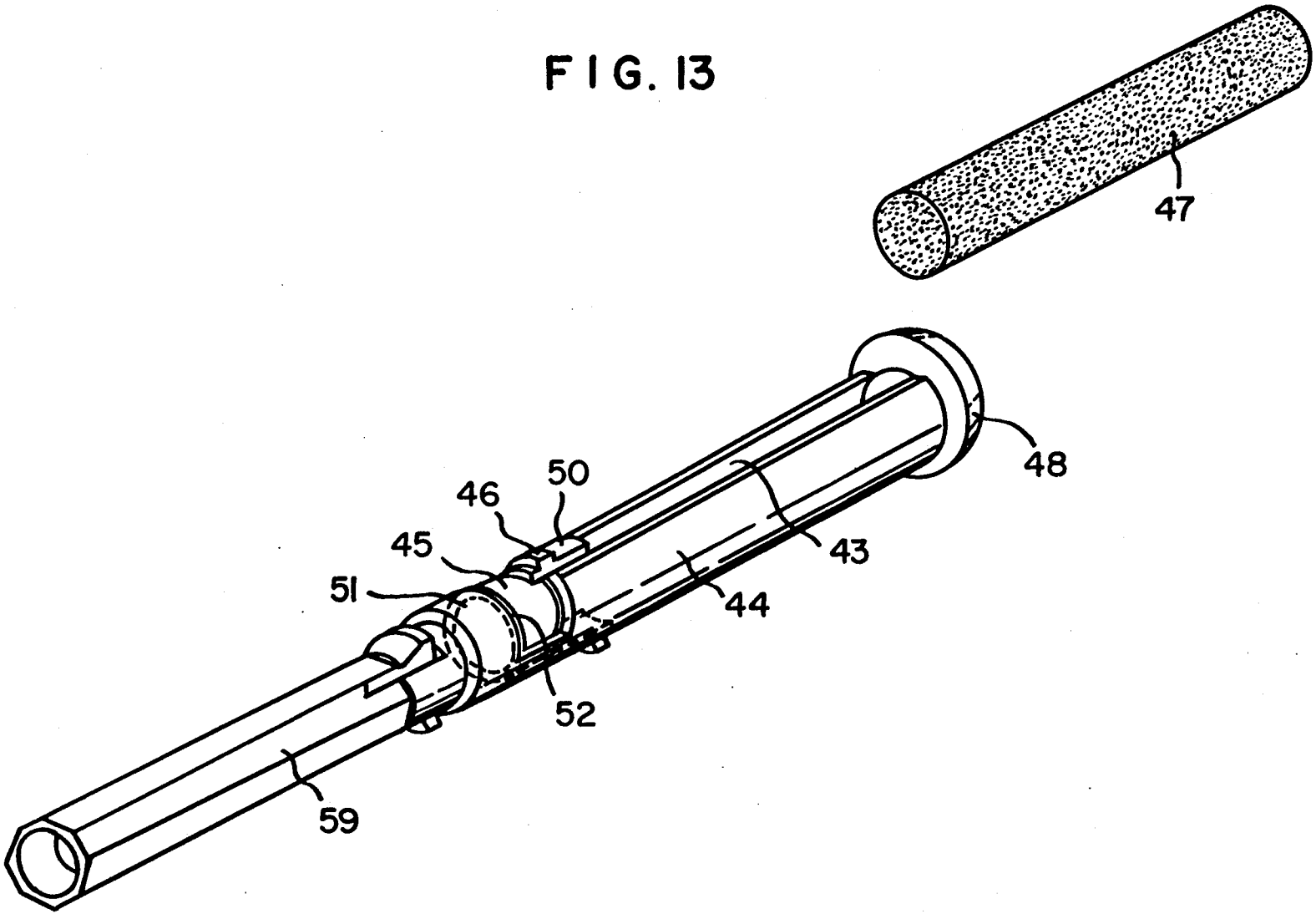
FIG. 13 is a perspective view of a holder mounted in a recess in the embodiment of FIG. 12.
Figure 14:
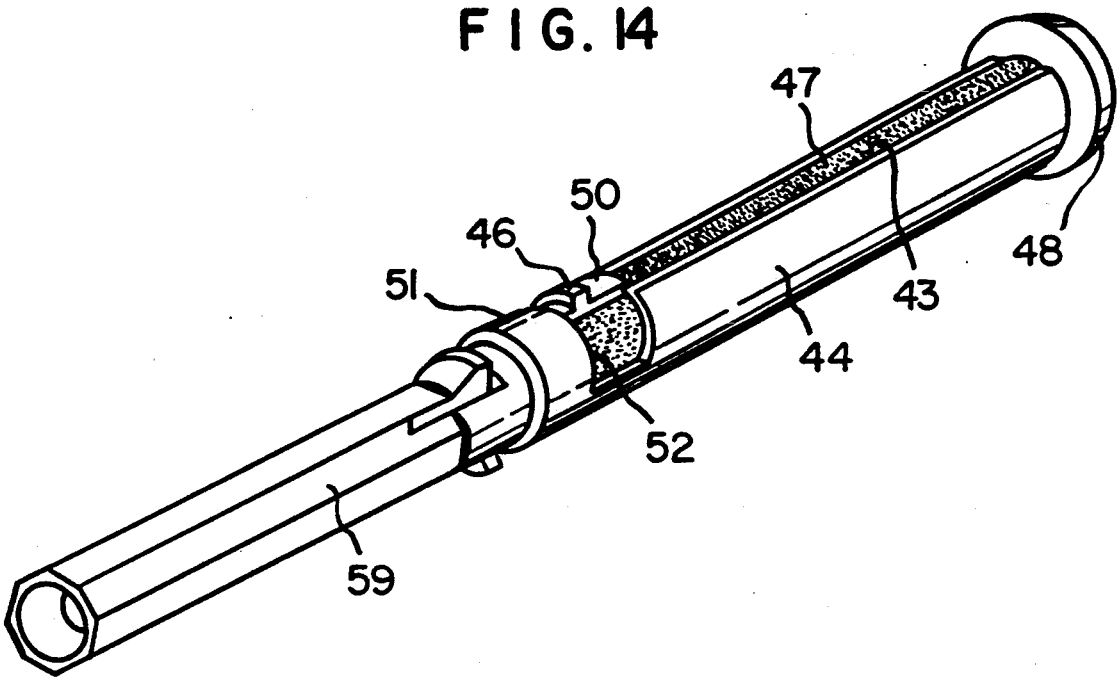
FIG. 14 is a perspective view of a holder inserted in a slit on an inner sleeve and having the bar shaped article of the fifth embodiment.

FIG. 11 is a longitudinal cross-section of a fifth embodiment of this invention. FIG. 12 is an exploded perspective view of an essential part of the embodiment. FIG. 13 is a perspective view of holder 45 mounted in recess 52. FIG. 14 is a perspective view of holder 45 inserted into slit 43 of inner sleeve 44 having a bar shaped article 47 according to the fifth embodiment.

In FIGS. 11–14, outer sleeve 41, has helical groove 42 provided on an inner face of the outer sleeve 41. Inner sleeve 44 is inserted into the outer sleeve from rear side, and a pair of slits 43 are provided at the rear part of inner sleeve 44. At the front part of one of said slit 43, radial recess 52 is provided and holder 45 is mounted in recess 52. Two holding pieces 50, 50 of holder 45 are slidably mounted in both slits 43, 43 and to directed rearward and bar shaped article 47 is held between the holding pieces 50, 50. Recess 52 may be provided at any position of the slit 43.

In this fifth embodiment, the shape of radial recess 52 provided in front of the slit is U shaped and the width $W_1$ of U shaped recess 52 is larger than the width $W_2$ of the sleeve part of the holder 45 so holder 45 may be easily mounted. Width $W_2$ is approximately equal to (or less than) or larger than the width $W_3$ of stopper 51.

Figure 15A:
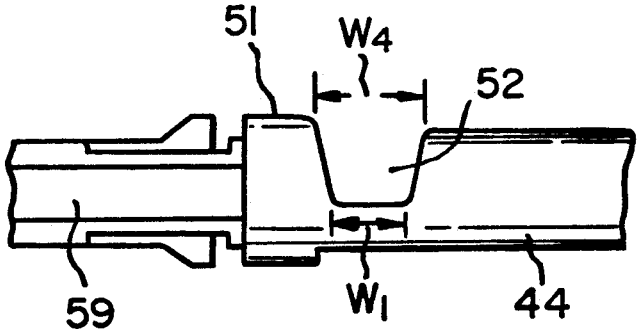
FIG. 15(*a*) (*b*) are side views of essential parts of sixth and seventh embodiments of the invention.
Figure 15B:
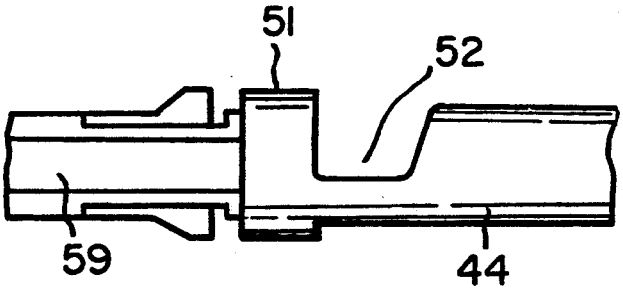

Otherwise, as shown in FIG. 15(*a*), in a sixth embodiment of the invention, the width of recess 52 is chamfered and spreads gradually from the width $W_1$ to width $W_4$ toward upper and outer edges. Alternately is shown in FIG. 15(*b*), a seventh embodiment of thes invention, the rear side of recess 52 is chamfered and spreads to ease mounting and after mounting the sleeve part of holder 45 stably enters stopper 51.

Stopper 51 and head 48 act as a stopper provided at opposite ends of holder 45. Consequently, the holder can move reciprocally in an axial direction within the range between stopper 51 and holder 48.

Projections 46, 46 provided on holding pieces 50, 50 engage the helical groove of outer sleeve 41.

As shown in FIGS. 11–14, the shape of the front part 59 of inner sleeve 44 may be polygonal. Front part 59 and the inner face of shaft member 57 for containing inner sleeve 44 also may be a polygonal shape at 58, so that polygonal shape at 58 of shaft member 57 locks with the polygonal shape 59 of inner sleeve 44 in peripheral (rotating) direction but allows a sliding action in an axial direction. Lead tank 55 in shaft member 58 abuts plate 56 of the innersleeve 44.

The following will explain the operation of this embodiment. Upon pressing head 48, lead tank 55 in shaft member 57 is pushed forward through plate 56, as with a prior mechanical pencil, and a chuck opens and closes so as to feed lead by a predetermined length. To retract the lead, pressing of the head 48 continually opening the chuck, and the end 1*f* the leadis pressed.

Holder 45 is inserted into the radial recess 52 at the front of slit 43. Holder 45 is slidably assembled in the inner sleeve 44 and holding piece 50 enters slit 43. In this case, it is possible to stably mount holder 45 in stopper 51. After mounting of the holder 45, bar shaped article 47 is inserted through head 48 and held by the holder 45. When the outer sleeve 41 is rotated relative to the inner sleeve 44, the holder 45 is guided and shifted in an axial direction along slits 43, 43 through engagement between the projection 46 and helical groove 42. Thus bar shaped article 47 held between two holding pieces 50, 50 is projected or retracted from the head 48 according to the direction of the rotation.

As explained above, according to this invention, in a mechanical pencil having a helical groove 42 provided on the inner face of an outer sleeve 41, a holder 45 is mounted in inner sleeve 44 having a slit 43. Projection 46 of the holder 45 engages helical groove 42 through the slit 43. Bar shaped article 47 held by holder 45 is projected or retracted from a head 48 by rotation of outer sleeve 41 relative to the inner sleeve 44. Radial recess 52 provided on slit 43 of the inner sleeve 44, receives holder 45 mounted in the recess 52. Holder 45 enteres radial recess 52 provided on the slit 43 of the inner sleeve 44. Holder 45 can be assembled in inner sleeve 44 without the necessity of a very strong force as in prior embodiments for deforming the holder 45 or holding piece 50 of the holder 45 inwardly so that holder 45 can be assembled easily and quickly. After holding of bar shaped article 47 in the holder 45, the holder 45 is kept stable.

We claim:

1. A mechanical pencil having a container for extending or retracting a bar shaped article comprising; an outer sleeve having a helical groove on an internal surface; an inner sleeve having a longitudinal slit; holding means for holding said bar shaped article; said holding means having a projection slidably mounted in said longitudinal slit; said inner sleeve and holding means being mounted in said outer sleeve with said projection engaging said helical groove through said longitudinal slit; a bar shaped article being firmly held in said holding means for extension or retraction from a head by rotation of said outer sleeve relative to said inner sleeve; said inner sleeve having a radial recess at a forward end of said longitudinal slit; said holding means being mounted in said inner sleeve with said projection engaging said longitudinal slit by inserting said holding means through said radial recess.

2. The mechanical pencil according to claim 1 in which said holding means includes holding pieces slidably retained in said slit when said holding means is mounted in said inner sleeve; said bar shaped article being firmly held between said holding pieces; said projection for engaging said helical groove being formed on the exterior of said holding pieces.

3. The mechanical pencil according to claim 1 in which said radial recess tapers inwardly with the narrowest portion being at least as wide as a sleeve portion of said holding means.

* * * * *